US005462652A

United States Patent [19]

Wegerer

[11] Patent Number: 5,462,652

[45] Date of Patent: Oct. 31, 1995

[54] SHORT CONTACT FCC PROCESS WITH CATALYST BLENDING

[75] Inventor: David A. Wegerer, Lisle, Ill.

[73] Assignee: UOP, Des Plaines, Ill.

[21] Appl. No.: 291,238

[22] Filed: Aug. 16, 1994

Related U.S. Application Data

[63] Continuation-in-part of Ser. No. 216,378, Mar. 23, 1994, which is a continuation-in-part of Ser. No. 125,723, Sep. 24, 1993, Pat. No. 5,346,613.

[51] Int. Cl.[6] ..... C10G 11/18

[52] U.S. Cl. ..... 208/167; 208/164; 208/113

[58] Field of Search ..... 208/167, 164, 208/173, 174, 157, 163, 113

[56] References Cited

U.S. PATENT DOCUMENTS

| | | | |
|---|---|---|---|
| 2,451,619 | 10/1948 | Hengstebeck | 196/52 |
| 3,679,576 | 7/1972 | McDonald | 208/74 |
| 3,821,103 | 6/1974 | Owen et al. | 208/72 |
| 3,849,291 | 11/1974 | Owen | 208/78 |
| 3,888,762 | 6/1975 | Gerhold | 208/120 |
| 3,926,778 | 12/1975 | Owen et al. | 208/74 |
| 4,118,337 | 10/1978 | Gross et al. | 252/417 |
| 4,285,908 | 8/1981 | Thompson et al. | 422/143 |
| 4,440,629 | 4/1984 | Stine | 208/111 |
| 4,481,103 | 11/1984 | Krambeck et al. | 208/120 |
| 4,717,467 | 2/1988 | Haddad et al. | 208/113 |
| 4,826,586 | 5/1989 | Herbst et al. | 208/70 |
| 4,853,105 | 8/1989 | Herbst et al. | 208/74 |
| 4,892,643 | 1/1990 | Herbst et al. | 208/70 |
| 4,917,790 | 4/1990 | Owen | 208/113 |
| 4,960,503 | 10/1990 | Haun et al. | 208/85 |
| 4,961,907 | 10/1990 | Herbst et al. | 422/144 |
| 4,985,136 | 1/1991 | Bartholic | 208/153 |
| 4,990,314 | 2/1991 | Herbst et al. | 422/144 |
| 5,017,343 | 5/1991 | Cetinkaya | 422/140 |
| 5,205,992 | 4/1993 | van Ommen et al. | 422/140 |
| 5,296,131 | 3/1994 | Raterman | 208/113 |
| 5,324,484 | 6/1994 | Gartside et al. | 422/144 |

*Primary Examiner*—Asok Pal
*Assistant Examiner*—Bekir L. Yildirim
*Attorney, Agent, or Firm*—Thomas K. McBride; John G. Tolomei

[57] ABSTRACT

A short contact time FCC process raises the coke level of the spent catalyst to improve regeneration zone kinetics and to decrease the total solids circulation through the unit by passing spent catalyst from the reaction zone back to a blending vessel. The blending vessel supplies a mixture of spent and fully regenerated catalyst to the reaction zone. The invention may also preferentially recover lightly coked catalyst by segregating catalyst from a separation device for recycle to the reaction zone.

17 Claims, 1 Drawing Sheet

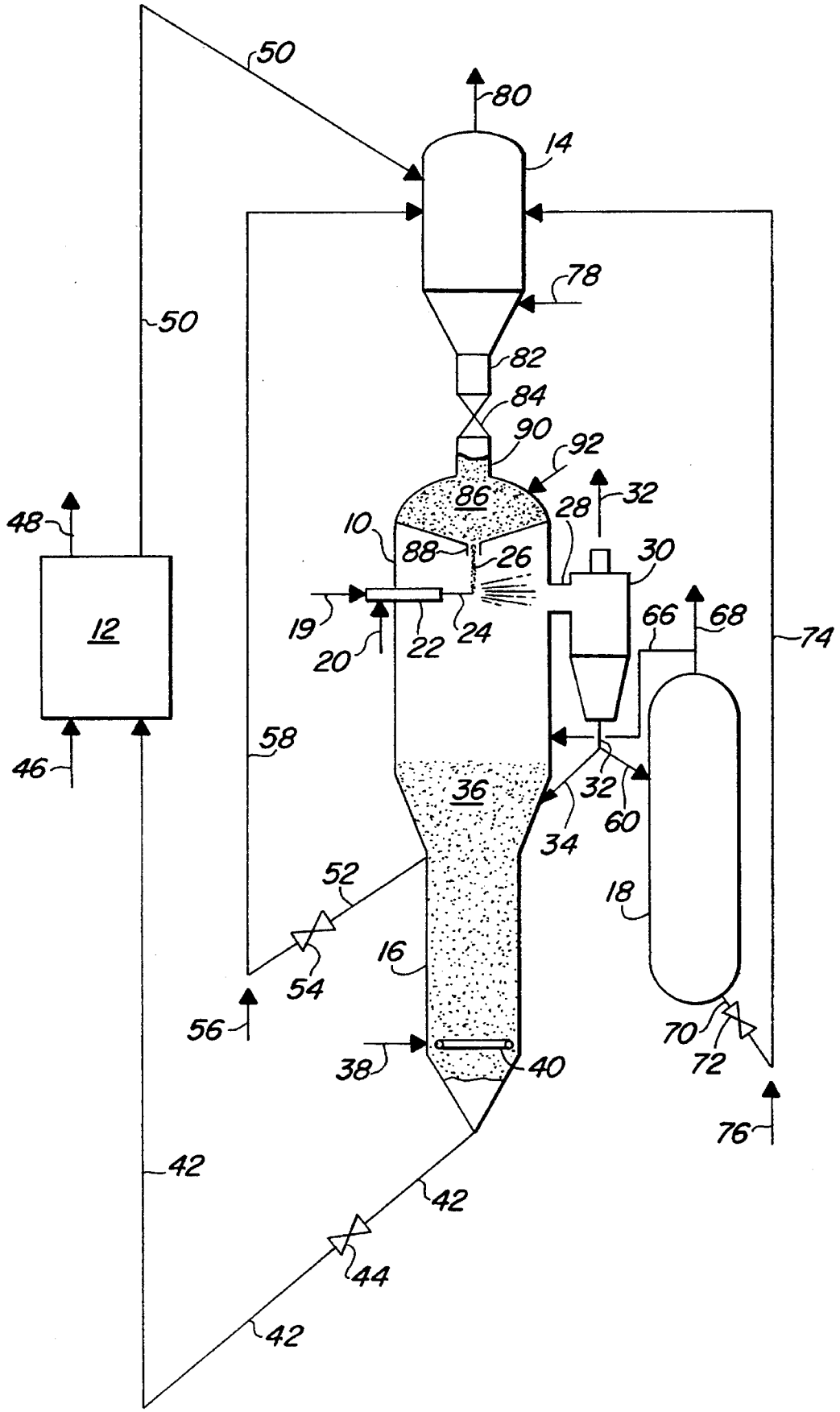
50
80
14
78
50
82
84
90
92
86
32
28
48
10
88
26
30
12
19
20
22
24
66
68
74
58
46
36
32
60
34
52
18
54
16
56
70
72
38
40
76
42
42
44
42

SHORT CONTACT FCC PROCESS WITH CATALYST BLENDING

CROSS REFERENCE TO RELATED APPLICATIONS

This application is a continuation in part of U.S. Ser. No. 08/216378 filed Mar. 23, 1994 which is a continuation in part of U.S. Ser. No. 08/125723 filed Sep. 24, 1993, now U.S. Pat. No. 5,346,613, the contents of which are both hereby incorporated by reference.

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst.

2. Description of the Prior Art

Catalytic cracking is accomplished by contacting hydrocarbons in a reaction zone with a catalyst composed of freely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

Despite the long existence of the FCC process, techniques are continually sought for improving product recovery both in terms of product quantity and composition, i.e. yield and selectivity. Two facets of the FCC process that have received attention are recovery of adsorbed products from the spent FCC catalyst and initial contacting of the FCC feed with the regenerated catalyst. Improvement in the recovery of hydrocarbons from spent catalyst and better initial feed and catalyst contacting improves the yield and selectivity to selectivity to more valuable products.

The processing of increasingly heavier feeds and the tendency of such feeds to elevate coke production and yield undesirable products has led to new methods of contacting FCC feeds with catalyst. Of particular interest recently have been methods of contacting FCC catalyst for very short contact periods. U.S. Pat. No. 4,985,136 discloses an ultrashort contact time fluidized catalytic cracking process, the contents of which are hereby incorporated by reference that contacts an FCC feed with a falling curtain of catalyst for a contact time of less than 1 second followed by a quick separation. U.S. Pat. No. 5,296,131 the contents of which are hereby incorporated by reference discloses a similar ultrashort contact time process that uses an alternate falling catalyst curtain and separation arrangement. The ultrashort contact time system improves selectivity to gasoline while decreasing coke and dry gas production by using high activity catalyst that contact the feed for a relatively short period of time. The inventions are specifically directed to zeolite catalysts having high activity. The short contact time arrangements permit the use of much higher zeolite content catalysts that increase the usual 25–30% zeolite contents of the FCC catalyst to amounts as high as 40–60% zeolite in the cracking catalyst. These references teach that shorter hydrocarbon and catalyst contact time is compensated for by higher catalyst activity.

In traditional long contact time FCC systems, it has been known to recycle catalyst from the end of a conversion zone that contains coke deposits, i.e., spent catalyst, back to the bottom of a reactor zone. Examples of long contact time risers that use this type of arrangement are shown in U.S. Pat. No. 3,679,576 where spent and regenerated catalyst pass together momentarily through a short section a relatively small diameter conduit before contacting the FCC feed. The contacting of spent catalyst, regenerated catalyst, and feed has been shown to occur simultaneously in U.S. Pat. No. 3,888,762 where all components come together simultaneously in a riser conduit. These types of arrangements have not been successfully practiced in commercial units.

Thus, in FCC operation generally and particularly in the short contact time operation, maximization of feedstock conversion is ordinarily thought to require essentially complete removal of coke from the catalyst. This essentially-complete removal of coke from catalyst is often referred to as complete regeneration. Complete regeneration produces a catalyst having less than 0.1 and preferably less than 0.05 weight percent coke. In order to obtain complete regeneration, oxygen in excess of the stoichiometric amount necessary for the combustion of coke to carbon oxides is charged to the regenerator.

While the prior art has recognized that the potential benefits of short contact times in high activity catalyst in FCC processing arrangements, little attention has been paid to the catalysts circulation aspects of the process. Ultrashort contact times will reduce the amount of catalytic coke deposited on the catalyst. Operating an ultrashort contact time FCC process with complete regeneration will increase the total mass of solids circulated for the combustion of a given amount of coke. This effect will produce lower regenerator temperatures. Increasing the total amount of solid circulation through the reactor and regenerator for the combustion of a fixed amount of coke will adversely affect the kinetics within the regeneration zone. Circulating large amounts of catalyst with low coke concentrations unnecessarily increases the amount of mass circulated throughout the unit.

BRIEF SUMMARY OF THE INVENTION

Circulation problems of short contact time FCC processes are overcome by mixing of spent catalyst with regenerated catalyst upstream of the ultrashort contact time contacting of the feed with the catalyst blend. Recycling a portion of the spent catalyst that already contains coke increases the total catalyst circulation to the ultrashort contact time contacting section without increasing circulation through the regeneration zone. Multiple cycles of contacting of the catalyst with the feed before entering the regeneration zone increases the average coke content of the FCC catalyst that is sent to the regeneration zone. Since the spent catalyst has been discovered to retain a substantial amount of its cracking activity in the short contact time application, the catalyst retains a large amount of its activity in the total so that a much greater amount of catalyst is available for contacting feed. The recycle of spent catalyst also increases the total amount of catalyst circulation through the reaction zone and promotes better heating and feed contacting within the ultrashort contact time. On the regenerator side of the process, the higher coke content of the circulating catalyst promotes a high temperature regeneration operation, thereby improving combustion kinetics, so that complete regeneration and CO combustion of the coke entering the regeneration zone is obtained.

Combining both regenerated and spent catalyst increases the solids to feed ratio in the reaction zone. A greater solids ratio improves catalyst and feed contacting. Since the spent catalyst still has activity, the catalyst to oil ratio is increased. Moreover, the larger quantity of catalyst more evenly and quickly distributes heat to the feed and aids in the necessary quick transfer of heat for ultra short contact time processing. In addition, the larger amount of catalyst transfers heat to the catalyst at a reduced temperature differential between the catalyst and the feed. Together both of these effects lead to more uniform feed and catalyst contacting and a resulting decrease in dry gas production.

Spent catalyst recycled to the reaction zone in accordance with this invention preferably undergoes stripping before recontacting the feed. This invention does not require complete stripping of spent catalyst before recycle of the spent catalyst to the ultrashort contact time reaction zone. It is important to strip the spent catalyst to remove hydrocarbons from the void spaces of the catalyst as quickly as possible. This quick removal prevents overcracking in the stripper and preserves hydrocarbons in the gasoline boiling range. Thus, the desired degree of stripping for catalyst returning to the reaction zone should provide displacement of hydrocarbons from the void spaces between and within catalyst particles. The remaining spent catalyst particles may undergo a more severe stripping operation to remove or react away hydrocarbon material adsorbed on the catalyst particles.

In another preferred form of practicing the invention, the method of ultrashort contact time contacting will provide a degree of separation between the more highly and less highly coke contaminated catalyst particles. The less highly coke contaminated particles will preferentially return to the ultrashort contact time contacting zone with a higher percentage of the heavily coked catalyst particles passing to the regeneration zone.

Accordingly, in one embodiment this invention is a process for the fluidized catalytic cracking of an FCC feed. The process forms a falling curtain of FCC catalyst in a reaction zone by discharging a mixture of FCC catalyst downwardly from a discharge point. The falling curtain of catalyst contacts the FCC feed in the reaction zone by discharging the feed transversely into the falling curtain of FCC catalyst to crack hydrocarbons in the feed and produce lighter hydrocarbon products. Contacting of the feed with the falling curtain of catalyst forms coke on the FCC catalyst. The hydrocarbon products are separated from the coked FCC catalyst after a hydrocarbon and catalyst contact time of less than 1 second, and a hydrocarbon product stream is recovered. A portion of the coked FCC catalyst passes to a regeneration zone that combusts coke from the coked FCC catalyst to produce a regenerated FCC catalyst having a carbon content of less than 0.1 wt %. Regenerated catalyst and coke containing catalyst are combined to produce the mixture of FCC catalyst.

Additional objects, embodiments, and details of this invention will become apparent from the following detailed description.

BRIEF DESCRIPTION OF THE DRAWING

The Figure is a schematic illustration of a short contact time FCC reactor arrangement that incorporates the spent catalyst recycle of this invention.

DETAILED DESCRIPTION OF THE INVENTION

This invention is more fully explained in the context of an FCC process. The drawing of this invention shows a typical FCC process arrangement. The description of this invention in the context of the specific process arrangement shown is not meant to limit it to the details disclosed therein. The FCC arrangement shown in FIG. 1 consists of a reactor 10, a regenerator zone 12, a blending vessel 14 which can also serve as a secondary stripper, a primary stripping vessel 16 and a displacement stripping vessel 18. The arrangement circulates catalyst and contacts feed in the manner hereinafter described.

The catalyst that enters the riser can include any of the well-known catalysts that are used in the art of fluidized catalytic cracking. These compositions include amorphous-clay type catalysts which have, for the most part, been replaced by high activity, crystalline alumina silica or zeolite containing catalysts. Zeolite catalysts are preferred over amorphous-type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, alumina, or zirconium. These catalyst compositions may have a zeolite content of 30% or more. Zeolite catalysts used in the process of this invention will preferably have a zeolite content of from 25–80 wt % of the catalyst. The zeolites may also be stabilized with rare earth elements and contain from 0.1 to 10 wt % of rare earths.

FCC feedstocks, suitable for processing by the method of this invention, include conventional FCC feeds and higher boiling or residual feeds. The most common of the conventional feeds is a vacuum gas oil which is typically a hydrocarbon material having a boiling range of from 650°–1025° F. and is prepared by vacuum fractionation of atmospheric residue. These fractions are generally low in coke precursors and the heavy metals which can deactivate the catalyst. Heavy or residual feeds, i.e., boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to a desired degree by regeneration and its deactivating effects overcome. Metals, however, accumulate on the catalyst and poison the catalyst. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline, and more coke and dry gas. Due to these deleterious effects, the use of metal management procedures within or before the reaction zone are anticipated in processing heavy feeds by this invention. Metals passivation can also be achieved to some extent by the use of an appropriate lift gas in the upstream portion of the riser.

Looking then at the reactor side of FIG. 1, FCC feed from a conduit 19 is mixed with an additional fluidizing medium from a line 20, in this case steam, and charged to an injection nozzle 22. Injection nozzle 22 atomizes the feed into a stream of fine liquid droplets 24 that contacts a falling curtain of catalyst 26. Contact of the feed with the catalyst causes a rapid vaporization and a high velocity discharge of catalyst in the direction of a cyclone inlet 28.

Contact between the feed and catalyst cracks the heavier hydrocarbons into lighter hydrocarbons and produces coking of the most active catalyst sites on the catalyst. As the catalyst moves toward cyclone inlet 28, a portion of the catalyst particles fall from the stream of mixed catalyst and feed downwardly through the reactor vessel into the top of primary stripping zone 16. The transverse contacting of the feed with the vertically falling catalyst curtain creates a beneficial trajectory of the catalyst and feed mixture towards inlet 28. Projecting the mixture of catalyst and cracked vapors toward the inlet 28 has the advantage of separating the catalyst particles. Advantageously, the heavier particles, those containing the most coke, preferentially fall into stripper 16 while the lighter less coked particles enter cyclone inlet 28 and are separated in cyclone 30. However, it is not necessary to the practice of this invention that the feed direct the catalyst in any particular direction.

The feed transversely contacts the curtain of falling catalyst to obtain a quick contacting between the feed and the catalyst particles. For the purposes of this description the expression transversely contacting means the feed does not flow parallel to the direction of the falling curtain. The feed injector 22 will produce a spray pattern that is compatible with the geometry of the falling curtain. Where the discharge point forms an annular falling curtain of catalyst, the feed injector will produce a radial pattern of flow that passes outwardly to contact the feed. Where the falling curtain has a linear shape as depicted in the figure, the feed injector will produce a flat horizontal pattern of atomized charge. In any arrangement, hydrocarbon feed and catalyst contact, the mixture moves rapidly towards a separation device such that the hydrocarbons are separated from the catalyst after a contact time of less than 1 second, and preferably, the feed and catalyst mixture enters a separation device after a contact time of from 0.5 to 0.01 seconds. After the initial contacting, feed may be directed upwardly or downwardly, but it is preferentially directed toward the inlet 28. Accordingly, in a typical arrangement, the feed is discharged in a substantially horizontal direction to flow perpendicularly into contact with an essentially vertical curtain of catalyst. When contacting the falling curtain of catalyst, the feed will typically have a velocity of greater than 10 ft/sec and a temperature in the range of from 300° to 600° F.

Cyclone 30 provides an inertial separation device that rapidly removes the product vapors from the FCC catalyst. Product vapors are recovered from the cyclone via a line 32 for further separation in a main column separation section. Catalyst separated by cyclone 30 flows down to the bottom of the cyclone where a line 32 removes the catalyst particles. From line 32, the catalyst may be directed into primary stripping zone 16 or displacement stripping zone 18. Typically only one of lines 34 or 60 will be provided such that catalyst flows only into primary stripping zone 16 or displacement stripping zone 18. Suitable flow control means (not shown) may also be positioned in conduits 34 or 60 to selectively direct the flow of catalyst from line 32 into one or the other of stripping zone 16 or displacement stripping zone 18.

Line 34 carries catalyst from the cyclone into primary stripping zone 16 where the catalyst is combined with heavier catalyst particles that fall directly into the top of a catalyst bed 36. Stripping fluid, typically steam, enters primary stripping zone 16 via a line 38 and a distributor 40. Primary stripping zone 16 may contain baffles or other internal trays or arrangements to increase contacting between the stripping fluid and the catalyst. As a stripping fluid flows countercurrently to the bed, the stripping fluid primarily displaces hydrocarbons in the upper portion of bed 36 and more fully strips the catalyst by desorbing adsorbed hydrocarbons from the core volume of the catalyst in the lower portions of bed 36. A line 42 withdraws the most fully stripped catalyst from the bottom of primary stripping zone 16 at a rate controlled by control valve 44. Spent catalyst leaving the stripping zone will typically have an average coke concentration of from 0.5 to 1.0 wt %.

Line 42 transfers spent catalyst to the regeneration zone 12 where a combustion gas carried by a line 46 contacts the catalyst under coke combustion conditions within regeneration zone 12 to remove coke from the catalyst particles. Combustion of the coke generates flue gases that contain the by-products of coke combustion and are removed from the regeneration zone via a line 48 and fully regenerated catalyst particles that have a coke concentration of less than 0.2 wt % and preferably less than 0.1 wt %. Regeneration zone 12 may be any type of known FCC regenerator or arrangement. Such regeneration arrangements include single stage regeneration zones that maintain a bubbling bed for the combustion of coke, multiple stage regeneration zones that operate with multiple dense beds or a combination of dilute phase and dense bed combustion or a dilute phase riser type regeneration zones. Depending on the type of regeneration zone, appropriate means may be provided for pneumatically lifting catalyst into the regeneration zone or transferring catalyst back to the reaction zone.

A line 50 transports catalyst from the regeneration zone into the blending vessel 14. The blending vessel also receives a portion of the spent catalyst from the reaction zone. In the simplest form of the invention, a line 52 withdraws spent catalyst from an upper section of primary stripping zone 16 at a rate set by control valve 54. A lift medium such as steam pneumatically conveys the spent catalyst upwardly from a line 58 into blending vessel 14. Line 52 withdraws catalyst that has primarily undergone stripping for displacement of hydrocarbons from the void spaces between the catalyst particles. Since the spent catalyst is recontacting the feed, there is no need for a thorough stripping of the catalyst before recycling it through the blending vessel and back to the reaction zone. Aside from blending catalyst, an added benefit of this invention is the use of the blending vessel as a hot stripping zone and a metals passivation zone. When present the blending vessel may hold catalyst for a relatively long residence time. The blending vessel can also isolate passivation gas streams from the reactor and regenerator sides of the process. Therefore, the blending vessel can simultaneously serve as a passivation zone. The blending vessel may also be useful for the removal of sulfur or inert material from the catalyst.

Sufficient coke containing catalyst will be recycled such that the mixture of catalyst in the reaction zone contains at least 20 wt % coked catalyst and more typically 50 wt % coked catalyst. The coked catalyst recycled by line 52 to blending vessel 14 comprises a random mixture of particles having varying degrees of coke ranging from particles that have made several cycles through the reaction zone and thus contain a heavy coke concentration to particles that have only passed once through the reaction zone since regeneration. It is, of course, more desirable to recycle those particles that have had a shorter residence time on the reactor side of the process and regenerate those particles that have had the most cycles through the reaction zone and thus the heaviest loading of coke. Since the particles with the lightest loading of coke tend to be lower density, they are preferentially carried into cyclone 30. The heavier catalyst particles, as previously mentioned, have a tendency to drop out first and land directly in bed 36. Therefore, the process can also be operated with displacement stripping zone 18 that withdraws the spent and preferentially less coked catalyst particles from the cyclone via a line 60 that transfers the catalyst particles to displacement stripper 18. A stripping gas enters the bottom of displacement stripper 18 via a line 62 and performs a partial stripping of the catalyst which is, again, to primarily displace hydrocarbons from void spaces between the catalyst particles and maximize the recovery of wider hydrocarbon products. Spent gas and hydrocarbon products are taken overhead from displacement stripper 18 via a line 64 and either transferred directly back to the reaction zone via a line 66 for recovery in cyclone 30 or removed separately via line 68 for independent recovery in a downstream separation section.

A line 70 removes the stripped catalyst at a rate regulated by a valve 72 for lifting to the blending vessel 14 in a line 74 with the assistance of an appropriate lift gas from a line 76. Blending vessel 14 mixes the catalyst. Blending vessel 14 receives the hot catalyst from line 50 and spend catalyst from either or both of lines 58 and 74. Blending vessel 14 provides a variety of functions. The blending vessel ensures a thorough mixing of the spent and regenerated catalyst so that a blend of catalyst is supplied to the reaction zone. The regenerated catalyst that enters the blending vessel has a temperature in a range of from 1200°–1400° F. and the coked catalyst will usually have a temperature of from 900°–1100° F. Blended catalyst, as it leaves the blending vessel will usually have a temperature in a range of from 1000°–1250° F. Blending the spent and regenerated catalyst in the manner of this invention typically increases the relative amount of catalyst that contacts the feed. The amount of blended catalyst that contacts the feed will vary depending on the temperature of the blended catalyst and the ratio of spent to regenerated catalyst comprising the catalyst blend. Generally, the ratio of blended catalyst to feed will be in ratio of from 5 to 25. The term "blended catalyst" refers to the total amount of solids that contact the feed and include both the regenerated catalyst from the regenerator and the spent catalyst from the reactor side of the process. Preferably, the blended catalyst to feed will be in a ratio of from 10 to 20 and more preferably in ratio of from 10 to 15. This higher ratio of catalyst to feed promotes more rapid vaporization of the feed and increases the catalyst surface area in contact with the feed to make vaporization more uniform. Both of theses effects promote a more uniform distribution of feed through the riser. The greater quantity of catalyst reduces the added heat per pound of catalyst for raising the temperature of the entering feed so that a high feed temperature is achieved with less temperature differential between the feed and the catalyst. Reduction of the temperature differential between catalyst and feed minimizes the occurrence of undesirable thermal cracking reactions and replaces violent mixing with the more complete contacting offered by the elevated volume of catalyst.

In addition to the blending vessel also providing a residence time for the spent and regenerated catalyst to reach thermal equilibrium, it can also provide for a beneficial interaction between the freshly regenerated catalyst and the spent catalyst. While not wishing to be bound to any theory, this residence time between the spent and regenerated catalyst may offer a tempering of the regenerated catalyst through contact with the volatile coke material present on the spent catalyst.

For purposes of blending and mixing, an additional fluidizing gas may enter blending vessel 14 via a line 78. Blending vessel 14 also provides a degassing function for venting fluidizing gases that convey the catalyst into the vessel. Fluidization gas, entering vessel 14 from line 78 promotes mixing of catalyst within the vessel. Fluidizing gas entering the blending zone will have normally establish a superficial velocity of between 1 to 3. The blending vessel will ordinarily maintain a dense catalyst bed. Conditions within the blending zone typically include a density in a range of from 30 to 40 $lb/ft^3$. Turbulent mixing within the dense catalyst bed fully blends the regenerated and spent catalyst. In this manner, mixing vessel 14 operates at least as a blending zone to supply the blended catalyst streams to the reactor and regenerator.

The blending zone may also provide an added stage of stripping. Stripping provides a particularly beneficial use of the blending zone. The blending of regenerated catalyst typically elevates the temperature of the blended catalyst so that a stripper blending zone provides hot stripping. Additionally, entrained inert gases from the regeneration step can be stripped from the catalyst in the blending vessel. Thus, the fluidizing gas entering through line 72 may comprise air, steam, additional feedstreams, etc.

A vent line 80 passes fluidizing gas out of the top of mixing vessel 14. Depending on its composition, the fluidizing gas may be passed back into the reactor for recovery of additional product vapors, processed separately to recover a secondary product stream or returned to the regeneration zone and combined with the flue gas stream exiting the regenerator.

A standpipe 82 at the bottom of blending vessel 14 supplies the blended catalyst mixture to a slide valve 84 that regulates the addition of the catalyst to the reaction zone. Catalyst from the slide valve enters a discharge chamber 86 that supplies catalyst to a discharge point 88. Discharge point 88 supplies a falling curtain of catalyst 26 that contacts the feed stream 24. The amount of catalyst discharged through discharge point 88 is a function of the size of the discharge point and the pressure head at discharge point 86. The pressure at discharge point 88 may be controlled in a variety of ways. Static pressure head may be provided by varying the height of a standpipe section 90 and controlling the level in that section through the regulation of catalyst passing through valve 84. A pressurization fluid may also be injected into discharge chamber 86 via a line 92. The pressurization fluid may provide a fluidizing function to maintain flow through discharge point 88 or may be used to increase the pressure in 88 and adjust the velocity of the curtain of catalyst passing through the discharge point. The falling curtain of catalyst will usually have a velocity of at least 10 ft/sec. The velocity through the discharge point may be increased in order to carry the mixture of hydrocarbon and catalyst farther down into the reactor vessel thereby lengthening the flow path and the residence time of the hydrocarbons within the reaction zone. Imparting greater momentum to the catalyst particles may also increase the separation between heavily and lightly coked catalyst particles such that the heavier coked catalysts are, again, more preferentially retained in the reaction zone and collected in directly in bed 36.

What is claimed is:

1. A process for the fluidized catalytic cracking (FCC) of an FCC feed, said process comprising:

a) forming a falling curtain of FCC catalyst in a reaction zone by discharging a mixture of FCC catalyst downwardly from a discharge point;

b) contacting said falling curtain of catalyst with said FCC feed in said reaction zone by discharging said feed transversely into said falling curtain of FCC catalyst to crack hydrocarbons in said feed and produce lighter hydrocarbon products while coking said FCC catalyst;

c) separating hydrocarbon products from the coked FCC catalyst after a hydrocarbon to catalyst contact time of less than 1 second;

d) recovering a hydrocarbon product stream;

e) passing a portion of said coked FCC catalyst to a regeneration zone and combusting coke from said coked FCC catalyst to produce a regenerated FCC catalyst having a carbon content of less than 0.1 wt %; and, f) combining regenerated catalyst with coked catalyst to produce said mixture of FCC catalyst.

2. The process of claim 1 wherein said falling curtain of catalyst is substantially vertical.

3. The process of claim 1 wherein said catalyst particles are discharged into said falling curtain of catalyst at a velocity of greater than 10 feet per second.

4. The process of claim 1 wherein said falling curtain of catalyst is annular in form.

5. The process of claim 1 wherein said mixture of FCC catalyst comprises at least 20 wt % coked catalyst.

6. The process of claim 1 wherein said feed is discharged substantially horizontally toward said curtain in a direction perpendicular to said curtain.

7. The process of claim 1 wherein said hydrocarbons are separated from said catalyst after a contact time of from 0.5 to 0.01 seconds.

8. The process of claim 1 wherein said hydrocarbon products are separated from the coked catalyst in an inertial separation zone.

9. The process of claim 1 wherein said coked FCC catalyst passes from a reaction zone to a stripping zone.

10. The process of claim 1 wherein a superadjacent vessel supplies catalyst to said falling curtain of FCC catalyst.

11. The process of claim 10 wherein coked FCC catalyst and regenerated catalyst flow into said vessel to supply said mixture.

12. The process of claim 8 wherein coked catalyst from said inertial separation device enters a first stripping zone wherein said coked catalyst is contacted with a stripping medium to displace hydrocarbons from the void space between said catalyst in said first stripping zone, a first portion of said coked catalyst from said first stripping zone is combined with said regenerated catalyst to produce said mixture of FCC catalyst and a second portion of said coked catalyst from said first stripping zone enters a second stripping zone.

13. The process of claim 8 wherein coked catalyst from said inertial separation device enters a stripping zone wherein said coked catalyst is contacted with stripping medium to remove product hydrocarbons from said coked catalyst, a first stream of coked catalyst is withdrawn from said stripping zone at a first location and passes to said regeneration zone and a second stream of coked catalyst is withdrawn from said stripping at a second location above said first location and is combined with said regenerated catalyst to produce said mixture of FCC catalyst.

14. The process of claim 1 wherein the catalyst to oil ratio in said reaction zone is at least 10:1.

15. The process of claim 1 wherein said inertial separator comprises a cyclone separator.

16. The process of claim 1 wherein said coked catalyst and said regenerated catalyst are blended to produce said mixture of FCC catalyst.

17. The process of claim 1 wherein said regenerated catalyst has a temperature in a range of from 1200° to 1400° F., said coked catalyst has a temperature of from 900° to 1100° F. and said catalyst mixture has a temperature of from 1000° to 1250° F.

* * * * *